US005397178A

United States Patent [19]

Konietzko

[11] Patent Number: 5,397,178

[45] Date of Patent: Mar. 14, 1995

[54] SCREW CONTAINER AS DISPENSER FOR PHARMACEUTICAL AND/OR COSMETIC OINTMENTS PRODUCED WITH A STIRRER

[76] Inventor: Albrecht Konietzko, Lugbank 9, D-96049 Bamberg, Germany

[21] Appl. No.: 185,995

[22] PCT Filed: May 13, 1994

[86] PCT No.: PCT/EP93/01194

§ 371 Date: Jan. 14, 1994

§ 102(e) Date: Jan. 14, 1994

[87] PCT Pub. No.: WO93/23156

PCT Pub. Date: Nov. 25, 1993

[30] Foreign Application Priority Data

May 16, 1992 [DE] Germany ..... 42 16 252.1

[51] Int. Cl.[6] ..... B01F 7/20

[52] U.S. Cl. ..... 366/197; 366/251; 366/259; 366/312; 366/347; 206/219; 215/DIG. 8

[58] Field of Search ..... 366/97, 98, 130, 139, 366/189, 197, 203, 279, 241–251, 255–259, 289, 309, 312, 313, 326, 332, 333, 347; 206/219, 221; 215/DIG. 8

[56] References Cited

U.S. PATENT DOCUMENTS

| | | | |
|---|---|---|---|
| 1,290,231 | 1/1919 | Kenley | 366/332 X |
| 1,430,070 | 9/1922 | Franzwa | 366/326 X |
| 1,435,289 | 11/1922 | Gilbert | 366/248 |
| 1,798,757 | 3/1931 | Roberts | 366/242 |
| 1,836,026 | 12/1931 | Helle | 366/256 |
| 1,998,692 | 4/1935 | Van Rossem et al. | 366/333 |
| 2,000,720 | 5/1935 | Snyder et al. | 416/228 R X |
| 2,166,437 | 7/1939 | Howie et al. | 366/256 X |
| 2,578,180 | 12/1951 | Edwards | 366/326 X |
| 2,907,496 | 10/1959 | Carstensen . | |
| 3,043,424 | 7/1962 | Howard | 366/244 X |
| 3,197,067 | 7/1965 | Rataczak | 366/333 X |
| 3,862,748 | 1/1975 | Grise et al. . | |
| 4,808,006 | 2/1989 | Kaufeler | 366/333 X |
| 4,858,759 | 8/1989 | Mauthe et al. | 206/221 |

FOREIGN PATENT DOCUMENTS

| | | | |
|---|---|---|---|
| 633642 | 12/1961 | Canada | 206/219 |
| 0178658 | 4/1986 | European Pat. Off. . | |
| 1070728 | 8/1954 | France . | |
| 1872487 | 5/1963 | Germany . | |
| 214769 | 10/1984 | Germany | 366/309 |
| 3638656 | 5/1988 | Germany . | |
| 439249 | 12/1935 | United Kingdom | 416/228 R |
| 8706852 | 11/1987 | WIPO | 366/251 |

*Primary Examiner*—David A. Scherbel
*Assistant Examiner*—Charles Cooley
*Attorney, Agent, or Firm*—Anderson Kill Olick & Oshinsky

[57] ABSTRACT

A device for mixing pharmaceutical, cosmetic ointments, pastes, creams, gels, emulsions and the like, including a screw container, a screw cap having an inner thread cooperating with an external rim thread of the container body of the container, a motor-driven shaft extending through a central opening of the cap and having a vane stirrer at its end for producing a prescription mixture, and a plug for closing the cap central opening when the shaft is removed.

9 Claims, 2 Drawing Sheets

SCREW CONTAINER AS DISPENSER FOR PHARMACEUTICAL AND/OR COSMETIC OINTMENTS PRODUCED WITH A STIRRER

BACKGROUND OF THE INVENTION

The invention deals with a screw container or jar used as a dispensing vessel for pharmaceutical and/or cosmetic ointments, pastes, creams, gels, emulsions or the like with or without addition of solid ingredients, producible by means of a stirring mechanism.

Prescription mixtures of fatty substances and gels are generally pulverized and manually mixed with other liquids, with or without addition of solid ingredients, in so-called ointment mortars by means of a pestle. Ointment mixing- or stirring machines offered commercially more or less imitate this process. In order to attain homogeneous mixtures the ointment must be built up slowly in several steps. The individual ingredients must be weighed separately and added to one another in several steps. If solid substances are not specifically dispersed at the start of the preparation, a subsequent fine processing with an ointment grinder can also become necessary in order to grind up remaining powder clumps or crystalline ingredients.

The manufacture is performed in wide open vessels with unimpeded access of air. The quantity of germs contained in the air which enter the mixing vessel is unwarrantably large. All instrumentation used must be thoroughly cleaned, in order to make it again ready for operation. In any case the mixed product must be decanted into a dispensing vessel or container.

Apart from the high procurement costs of the above-mentioned ointment mixing- and stirring machines, the production process including the preparation and post-production activities is very time- and thus cost-intensive.

Compared to that the invention is based upon the task of remedying this discrepancy and to enable a thorough intermixture of ointments, pastes, creams, gels and emulsions or the like, especially in the area of small dispensed quantities for instance as they occur in prescription mixtures and to avoid decanting of the prescription mixtures out of large open mixing vessels into small dispensing vessels.

SUMMARY OF THE INVENTION

The invention solves this task by making a screw container or jar configured as a dispensing vessel to be used simultaneously as a mixing vessel when manufacturing prescription mixtures, whose screw cap, which can be threaded upon an external thread of the jar body, comprises a closeable center aperture for passing the drive shaft of a stirring tool of the stirring mechanism through same.

The intermixing of the prescription ingredients in a closed system occurs largely without air penetration. A transfusing of ointments, pastes, creams, gels emulsions or the like out of a large mixing vessel into small dispensing vessels is eliminated. The mixing vessel serves simultaneously as a dispensing vessel but also as a storage container.

A sealing plug tied to the screw cap is provided for sealing the central aperture.

Two screw jars or containers can be used in the invention. In a first embodiment example the jar body is a circular cylinder, whose end opposite the external thread comprises an aperture in the base and an internal ring, and in which a bottom is disposed so as to be displaceable. Thus it is possible to press the contents of the screw jar little by little through the central aperture of the screw cap or through an applicator out of the screw jar or screw container. It is possible within the frame of the invention to fasten different applicators by a clip-on connection in the central aperture of the screw cap.

It is significant that the central aperture in the screw cap is configured as a portion of a clip-on connection for fastening different applicators.

In a second embodiment example the internal jacket and the external jacket of the container body taper truncated cone-like from the external thread towards the stationary base. Herein the internal surface of the stationary base is matched to the shape of the stirring tool.

In order to assure a particularly good intermixture of the ingredients of the prescription mixture in a space containing very little air, a vane stirrer is used as a stirring tool fixable at the end of the drive shaft of an electromotor with controllable rpm, which stirrer can be introduced into and removed from the screw container; this vane stirrer is provided with areas which rest at or can be applied under pressure to the internal surfaces of the screw container.

In detail the stirring tool has stirring vanes configured to be half-moon shaped with friction faces of the vane parts which are lagging in the course of the stirring process, which friction faces rest elastically at the internal jacket of the container or jar body. The vane ends are pulled as far into the mixing area, that the pressure of the friction faces against the internal jacket of the screw container is increased during rotation of the stirring tool due to the inertia of the products being mixed. Herein the spacing between opposite friction faces in the extended state is greater than the diameter of the screw containers.

In the following embodiment examples will be explained with the help of the drawing.

DETAILED DESCRIPTION OF THE PREFERRED EMBODIMENTS

Figure 1:
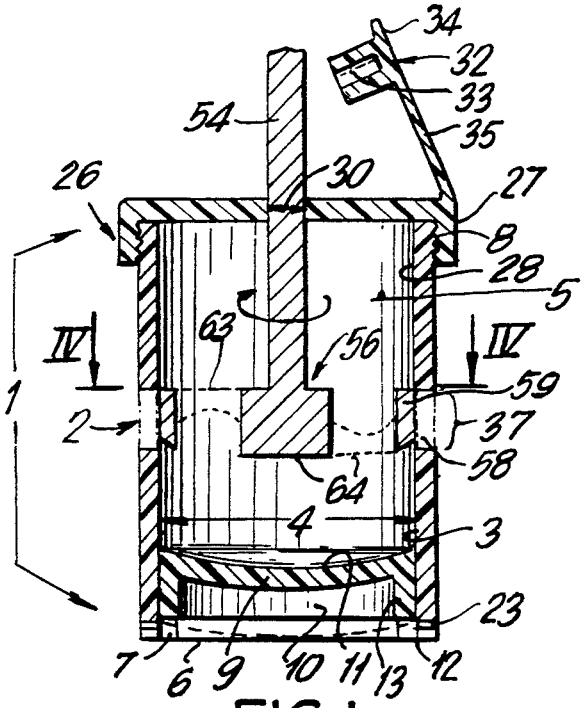
FIG. 1 a cross-section through a first embodiment of a screw container of the invention along the line I—I in FIG. 4, FIG. 2 a cross-section through a screw cap, FIG. 3 a cross-section through a container body in a second embodiment of a screw container of the invention, FIG. 4 a cross-section along the line IV—IV in FIG. 1 with plan view upon a stirring tool, FIG. 5 two cross-sections along the line V—V in FIG. 4.

FIG. 1 shows a screw container 1 in cross-section with a container body 2 configured as a circular cylinder. It has an internal jacket 3 with a diameter 4. The upper region of the external jacket 5 of the screw container 2 is provided with an external thread 8.

A base aperture 6 is disposed in the bottom or base of the jar or container body 2, which is enclosed by an internal ring 7.

A displaceable bottom 9 can slide inside of the container body 2 configured as a circular cylinder, which bottom has an internal surface 11 and whose diameter 10 corresponds to the diameter 4 of the container body. The displaceable bottom 9 is slightly arched and has an external edge 12 which transits into a sliding ring 13. The bottom 9 can be easily pushed upwards through the base aperture 6. Its external edge 12 seals against the internal jacket 3 of the container body 2. A screw cap 26, whose rim 27 is provided with an internal thread 28, is threaded upon the external thread 8 of the container body 2. The screw cap 26 is provided with a central aperture 30 having an internal diameter 31. The central aperture can be closed by a sealing plug 32, which comprises a central longitudinal opening 33 which provides its elasticity. Furthermore, it is equipped with a gripping nose 34 and is fastened to the screw cap 26 by means of a connecting strip 35. Two oppositely located holes 23 in the lower region of the container body 2 are provided for fastening the container body on a stand 50.

Figure 2:
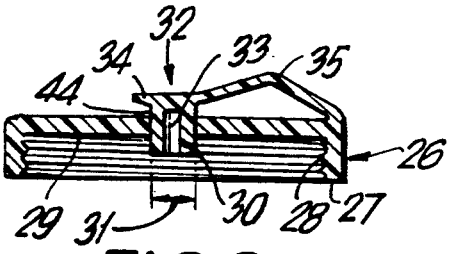

FIG. 2 shows the cross-section through the screw cap 26, wherein the sealing plug 32 seals the central aperture 30.

Figure 3:
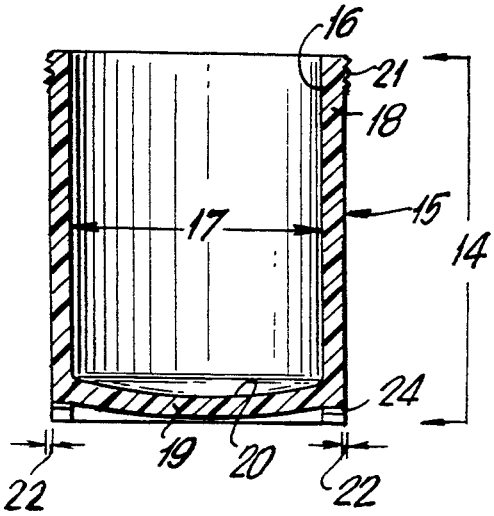

FIG. 3 shows a second embodiment example of a container body 15. The internal jacket 16 and the external jacket 18 are designed to be truncated cone-shaped for fabrication reasons. The taper of the container body 15 towards the fixed base 19 is indicated by the angle 22.

The average diameter of the internal jacket 16 is designated by the numeral 17. The fixed base has an arched internal surface 20. The shape of the base is matched to the lower surface region of the stirring tool.

The external thread 21 in the upper region of the external jacket 18 corresponds to the internal thread 28 in the rim 27 of the screw cap 26. Two oppositely located holes 24 in the lower region of the container body 15 are provided for fastening the container body upon the stand 50.

Figure 4:
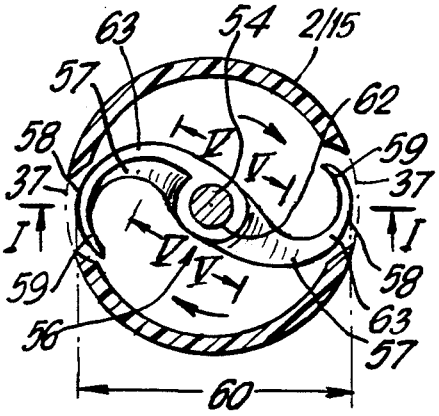

FIG. 4 shows the section along the line IV—IV in FIG. 1 with a plan view upon the stirring tool.

As can be seen from FIG. 1 the parts 37 in the wall of the container body have been cut away for better explanation. This is indicated by cross shading. The cutout parts 37 are also shown in FIG. 4 in order to demonstrate that the lagging vane part 59 of the vane stirrer 56 have in the extended state a spacing 60 between the friction faces 58, which is greater than the internal diameter 4 or the average diameter 17 of the container body 2 or 15. As stated the cutout parts 37 are shown only for demonstration purposes.

The vane stirrer 56 has moon-shaped stirrer vanes 57 which end in vane portions 59 which lag upon rotation. The vane parts 59 are pulled backwards to such an extent inside of the container, that upon rotation they increasingly press against the internal walls 3, 16 of the screw container 1, 14 because of the inertia of the mixed material.

Figure 5:
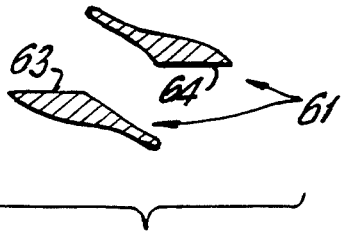

FIG. 5 shows a cross-section along the line V—V in FIG. 4. Principally in the transition region between the hub 62 of the vane stirrer and the stirrer vane 57 the cross-section is designed similar to aircraft propeller profiles 61, whereby the mixed material is pressed in the course of the mixing process against the internal surface 11 of the displaceable bottom 9 or the internal surface 20 of the fixed bottom 19.

The vane stirrer 56 is shown in FIG. 1 in cross-section along the line I—I in FIG. 4. It is clearly seen how the friction surfaces 58 espouse the internal jacket 3 of the container body 2. The vane stirrer 56 sits at the end of a drive shaft 54, which is conducted through the central aperture 30 of the screw cap 26. Because of the elasticity of the stirrer vanes 57 the mixing process is not affected by the truncated cone-like construction of the internal jacket 16 of the screw container 14.

The lower regions 64 of the vane stirrer 56 are adapted as far as their shape goes to the internal surface 11 or 20. The upper regions 63 of the vane stirrer 56 are matched to the internal surface 29 of the screw cap 26.

Figures 6A, 6B, 6C, 6D, 6E, 6F:
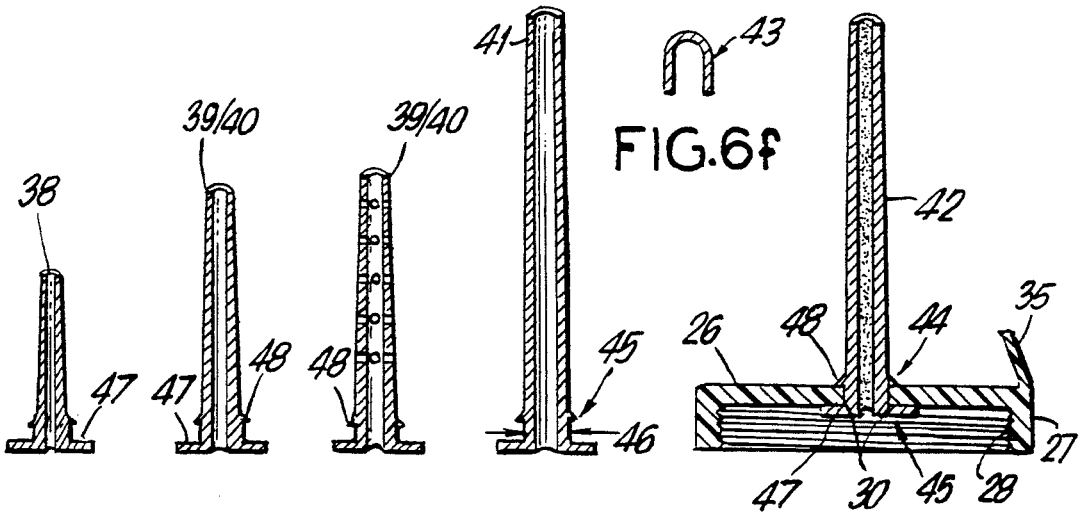
FIG. 6*a* shows a cross-sectional view of a first embodiment of an applicator for use with a screw container according to the present invention.
FIG. 6*b* shows a cross-sectional view of a second embodiment of an applicator for use with a screw container according to the present invention.
FIG. 6*c* shows a cross-sectional view of a third embodiment of an applicator for use with a screw container according to the present invention.
FIG. 6*d* shows a cross-sectional view of a fourth embodiment of an applicator for use with a screw container according to the present invention.
FIG. 6*e* shows a cross-sectional view of a connection of an applicator with the screw cap of the screw container of the present invention.
FIG. 6*f* shows a cross-sectional view of a seal cap for an applicator.

FIGS. 6*a*–6*d* show applicators which have been developed for the screw container in the invention to satisfy the requirements of DAB for application of ointments. Thus, FIG. 6a shows a cross-section of suitable applicators (nose and ear 38, rectum 39, 40 and vagina 41). FIG. 6*e* shows the connection of the applicator 42 with the screw cap 26. The connection is achieved by means of a clip-on connector 44. The central aperture 30 in the screw cap 26 is a part of this clip-on connector. Each applicator 38 to 42 comprises a lower region 45 whose diameter 46 corresponds to the diameter 31 of the central aperture 30 in the screw cap 26. Each applicator 38 to 42 terminates in an end ring 47 above which a bead 48 for clipping is disposed. The spacing between the end ring 47 and the bead 48 for clipping corresponds to the thickness of the screw cap 26. FIG. 6*f* shows a seal cap 43 for an applicator.

Figure 7:
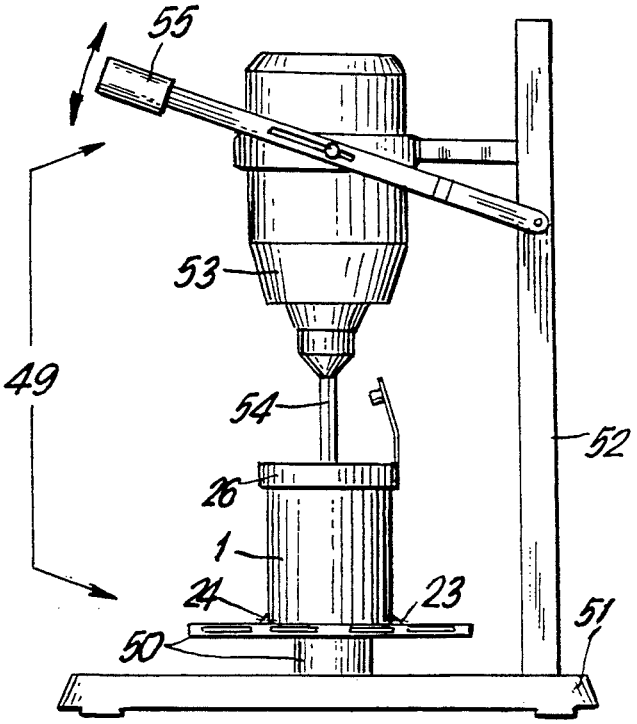
FIG. 7 a diagramatic view of a stirring mechanism.

FIG. 7 shows diagrammatically a stirring mechanism 49 which can drive the vane stirrer 56. A stand 52 is disposed on a stand plate 51, upon which stand an electric motor 53 whose rpm can be controlled if attached. This electromotor can be moved up and down in a known manner by means of a handle 55, as this is indicated by a twin arrow next to the handle 53. The described vane stirrer 56 is joined to the end of the drive shaft 54.

The screw container 1 with screw cap 26 is only outlined.

The stirring process can proceed while the operator holds the screw container 1, 14 in one hand and moves same slowly up and down relative to the vane stirrer which is not shown here.

Without abandoning the core of the invention, the screw containers can also be fastened on a stand 50 and the electromotor 53 can be moved up and down automatically or by the handle 55.

After the termination of the stirring process the screw cap 26 is unscrewed from the screw container 1, 14. Then the drive shaft 54 can either be loosened from the chuck of the electric motor 53 and the screw cap can thus be removed from the drive shaft 54. It is however also possible to detach the vane stirrer 56 from the end of the drive shaft 54, in order to pull the cap 26 off the drive shaft 54.

After the stirring process the central aperture 30 of the screw cap is either closed by the sealing plug 32 or applicators shown in FIG. 6 are already now introduced into the central aperture 30 and sealed there by a sealing cap 43. The applicators are thus locked so tightly in the screw cap, that they do not slip out of position in the course of the application of ointment, however they can be easily replaced if need be.

The screw containers can be fabricated from any arbitrarily known material. The vane stirrers can consist of spring steel or nylon. Both materials permit elastic deformation.

If the mixing- or dispensing vessel is fastened upon a stand 50 below the electric motor 53, the stroking motion of the vane stirrer 56 can be performed from a stop at the internal surface 29 of the screw cap 26 up to the stop at the internal surface 11 or 20 at the base of the screw container. Without changing anything in the essence of the invention this relative motion between the screw container 1, 14 and the vane stirrer 56 can also be performed manually with the electric motor 53 not operating.

In the course of the stirring process the rising and dropping friction surfaces 58 at the end of the stirrer vanes 57 are particularly advantageous, which are kept under pressure because of the greater spacing 60 and the half-moon shaped vane curvature and are pressed against the internal jacket of the container body and which, because of the specific design of the vane ends, themselves increase the frictional pressure as a function of the speed of rotation.

In the invention screw containers 1, 14 with volumes of 10, 20, 30, 50, 75, 100, 150, 200, 250, 300 or 500 ml can be used.

It is advantageous that in the course of rotation of the vane stirrer the frictional surfaces 58, 63, 64 come into close contact with the internal faces of the screw container under the effect of the frictional pressure. This makes it possible to also pick-up extremely viscose admixtures and to distribute same in the mixed product in a homogenous manner.

The elliptical widening of the hub 62 in the region of the vane stirrer 56 and the design of the cross-section of these regions as aircraft propeller profiles 61 produce a downward thrust similar to the action of a propeller, whereby a more rapid distribution of the intermixed material is achieved. Coarse flocculate powder and fine crystalline ingredients are ground up between the friction surfaces and the internal surfaces of the container body and can thus be distributed in the mixture in finely dispersed manner. Rpm's up to 2000 revolutions per minute are desirable for dispersing solid ingredients, while during mixing emulsifying 100 to 500 revolutions per minute are adequate.

The invention allows to use stirring tools of differing shapes in the stirring- or mixing device depending upon the substances to be mixed (for instance powder or ointment mixtures devoid of solid materials).

The invention permits that nearly all ingredients are simultaneously weighed out into the container in the course of preparation of for instance an ointment. Extremely homogeneous results are achieved generally in less than a minute as a function of the adjusted rpm of the electric motor 53.

In dispensing vessels with displaceable bottoms the air can be mainly evacuated to such an extent by upward movement of the bottom after the prescription ingredients have been filled into the container, that microbial contamination as well as undesirable air inclusions and air oxidation are largely eliminated. Approximately the same conditions exist, if the size of the container with fixed bottom is matched or adapted to the quantity of the material to be mixed. As for the preparation of prescriptions, AMP-instructions are satisfied by both containers. The preparation of an ointment in a closed system with very little air leads to a better durability result than does the conventional fabrication method.

After termination of the stirring- and mixing process the vane stirrer is removed. The mixing vessel is sealed by the screw cap 26. If required an applicator can be inserted. Otherwise the sealing plug 32 is pressed into the central aperture 30 after which the prescription mixture is ready to be dispensed.

Considerable time can be saved in the invention by reduction of work processes and considerable shortening of the mixing process. Herein the stirring tool 56 is the only working item which has to be cleaned.

The user has two possibilities to withdraw the substance in selecting a dispensing vessel where a displaceable bottom 9 has been installed:

1. The user can, as is the case with the vessels now in use and the dispensing vessel with a fixed bottom, remove the screw cap and withdraw the mixed substance or 2. the user opens the stopper in the screw cap and pushes with light pressure upon the bottom piston the mixed substance through the central aperture in the screw cap or through an applicator.

This possibility prevents a subsequent contamination of the mixed substance by germs in the air, but also the so often observed change of the mixed substance surface through air oxidation or drying-out during storage. Durability results are achieved by selecting a dispensing vessel with displaceable bottom 9, which otherwise can only be achieved by the DAB specified flexible metal tube.

What is claimed is:

1. A device for mixing and dispensing of pharmaceutical, cosmetic ointments, pastes, creams, gels and emulsions, said device comprising:

a screw container having a container body with an external rim thread;

a screw cap for closing said screw container and having an inner thread cooperating with said external rim thread, and a central opening;

means for mixing the contents of said screw container, said mixing means including:

a drive shaft extendable through said central opening into said container body, a vane stirrer secured at a free end of said drive shaft for producing a prescription mixture, said vane stirrer having friction surfaces engaging an inner surface of said container body during mixing, a speed-adjustable electric motor for driving said drive shaft;

an applicator releasably securable in said central opening, when said mixing means is disconnected from said screw container, and for dispensing the contents of said screw container;

means for closing said central opening of said screw cap upon removal of one of said drive shaft and said applicator.

2. A device as set forth in claim 1, wherein the container body is formed as a cylinder having a bottom opening, said container body further including an inner ring arranged at said bottom opening, and a bottom displaceable in an interior of said container body.

3. A device as set forth in claim 2, wherein said displaceable bottom has an inner surface which corresponds to a shape of said vane stirrer and an external rim defining an inner sliding ring.

4. A device as set forth in claim 1, wherein said container body has a fixed bottom having an inner surface with a shape corresponding to a shape of said vane stirrer, and inner and outer surfaces which narrow from said external rim thread toward said bottom in a form of a truncated cone.

5. A device as set forth in claim 1, wherein said vane stirrer comprises arcuate stirring vanes, wherein said friction surfaces are provided at vane portions of said stirring vanes which lag during stirring, wherein said friction surfaces elastically engage said inner surface of said container, and wherein a distance between oppositely located friction surfaces is greater than a diameter of said container in an extended condition of said stirring vanes.

6. A device as set forth in claim 5, wherein said vane stirrer comprises two stirring vanes.

7. A device as set forth in claim 5, wherein a transition region between each of said stirring vanes and a hub of said vane stirrer has an airfoil curved profile, whereby a stirrable substance is pressed, during stirring, against a bottom of said container.

8. A device as set forth in claim 1, wherein said screw cap has, in a region of said central opening, clip-on means for releasably securing said applicator in said central opening.

9. A device as set forth in claim 8, wherein said closing means is formed integrally with said screw cap.

* * * * *